US005591013A

United States Patent [19]

Kawafune et al.

[11] Patent Number: 5,591,013

[45] Date of Patent: Jan. 7, 1997

[54] FLUID PRESSURE GENERATING DEVICE

[75] Inventors: Kazunori Kawafune; Masaaki Suhara; Masahito Hiraki, all of Settsu, Japan

[73] Assignee: Daikin Industries, Ltd., Osaka, Japan

[21] Appl. No.: 211,315

[22] PCT Filed: Aug. 3, 1993

[86] PCT No.: PCT/JP93/01083

§ 371 Date: Apr. 1, 1994

§ 102(e) Date: Apr. 1, 1994

[87] PCT Pub. No.: WO94/03726

PCT Pub. Date: Feb. 17, 1994

[30] Foreign Application Priority Data

Aug. 6, 1992 [JP] Japan ..... 4-210313

[51] Int. Cl.[6] ..... F04B 1/22; F04B 35/04

[52] U.S. Cl. ..... 417/271; 417/222.1; 417/356

[58] Field of Search ..... 417/269, 271, 417/410, 222.1, 222.2, 356, 372; 91/499

[56] References Cited

U.S. PATENT DOCUMENTS

| | | | |
|---|---|---|---|
| 3,295,457 | 1/1967 | Oram | 417/222.1 |
| 3,672,793 | 6/1972 | Yowell | 417/271 |
| 4,729,717 | 3/1988 | Gupta | 417/356 |
| 4,850,812 | 7/1989 | Voight | 417/271 |
| 5,220,225 | 6/1993 | Moon, Jr. | 417/271 |

FOREIGN PATENT DOCUMENTS

| | | |
|---|---|---|
| 45-35944 | 11/1970 | Japan . |
| 46-32900 | 9/1971 | Japan . |
| 57-73867 | 5/1982 | Japan . |
| 59-231179 | 12/1984 | Japan . |
| 61-116192 | 7/1986 | Japan . |

*Primary Examiner*—Timothy Thorpe
*Assistant Examiner*—Peter G. Korytnyk
*Attorney, Agent, or Firm*—Birch, Stewart, Kolasch & Birch, LLP

[57] ABSTRACT

A fluid pressure generating device is provided which is capable of reducing noise and vibration and improving durability and yet which is simple in construction and successful in assemblability. A cylinder block having a main shaft substantially at a center thereof and a plurality of cylinders on an outer peripheral portion, each of the cylinders having a piston slidably provided therein, is formed separately of a rotor. The rotor has a fitting hole positioned substantially at a center thereof, to which fitting hole the cylinder block is fitted and secured. The rotor is rotatably supported by a stationary member via the cylinder block and the main shaft. A piston actuator having an inclined surface on which shoes slidably retained by head portions of the pistons, is provided on one axial side of the cylinder block while a valve plate is provided on the other side of the cylinder block.

27 Claims, 12 Drawing Sheets

FLUID PRESSURE GENERATING DEVICE

FIELD OF THE INVENTION

The present invention relates to a fluid pressure generating device. More specifically, the invention relates to a fluid pressure generating device having a motor and a liquid pump driven by the motor both contained within one casing.

BACKGROUND ART

In general, a fluid pressure generating device comprising a motor and a liquid pump driven by the motor is provided in the following construction. That is, the liquid pump (hereinafter, referred to as a pump) and the motor that drives the pump (hereinafter, referred to as a motor) are formed independently of each other. Then the output shaft of the motor is coupled with the input shaft of the pump via a coupling so that driving force of the motor is transmitted to the pump (Japanese Utility Model Laid-Open Publication No. 61-116192).

However, when the pump and the motor are formed independently of each other as shown above, there has been a problem that noise would occur at the shaft coupling portion because of misalignment between the output shaft and the input shaft. In addition, the operating noise of the pump and the motor result in a great noise as a whole. Also, since the pump and the motor are directly coupled with each other in the axial direction, the resulting axial length would become rather long so that the fluid pressure generating device as a whole would be a large size which would be a disadvantage.

Thus, as shown in Japanese Patent Publication for opposition No. 46-32900, a fluid pressure generating device was proposed which has a motor 102 and a pump 103 both contained within one casing 101, so that noise reduction and device downsizing can be implemented.

In this device, as shown in FIG. 12, a rotor 104 of the motor 102, which rotor is formed of laminated steel sheets, is rotatably supported to a main shaft 130 secured to the casing 101, via a pair of bearings 131, 132. The rotor 104 is provided with a plurality of holes 105, to which holes 105 and sleeves 106 are fitted, so that a plurality of cylinders 107 are formed. Further, pistons 108 are slidably provided in the cylinders 107. On the other hand, cylinder port plate 111 having a kidney-shaped ports 110 is disposed on one axial side of the rotor 104. One axial one end of each sleeve 106 is fitted to the cylinder port plate 111. A seal member 112 is provided between the fitting portion of the cylinder port plate 111 and the outer periphery of a sleeve 106. By this arrangement, the sleeves 106 and the rotor 104 have such a degree of freedom that they can move in both the axial and tilt-rotating direction relative to the cylinder port plate 111. Outside the cylinder port plate 111, a valve plate 116 with a suction port (not shown) and a discharge port 115 is disposed. This valve plate 116 is fixedly provided to the casing 101. The cylinder port plate 111 is put into sliding contact with the sliding surface of the fixed valve plate 116 so as to be rotatable relative to the sliding surface. Meanwhile, on the other axial side of the rotor 104, a swash plate 122 is provided which has an inclined surface on which shoes 121 retaining the head portions of the pistons 108 will slide. Further, a pressure plate 123 is provided so as to be fitted to the sleeves 106 on the other axial end side of the sleeves 106. One end face of this pressure plate 123 is in close contact with an end face of the rotor 104. A spherical retainer 125 for retaining the shoes 121 is fitted to a spherical portion 124 at the front end of the pressure plate 123.

The fluid pressure generating device constructed as described above is in such a coupling structure that the fitting portion between the cylinder port plate 111 and each sleeve 106 has a degree of freedom. Therefore, the cylinder port plate 111 and each sleeve 106 will be caused to move to each other in the axial direction by pressure variation within each cylinder 107. Also, the number of rotations of the motor 102 will vary due to load variation of the pump 103. In accompaniment to this variation, the cylinder port plate 111 and each sleeve 106 will be caused to move to each other in the rotating direction. By such relative movement in both the axial and rotating direction, noise will be generated at the fitting portion between the cylinder port plate. 111 and each sleeve 106. In addition, because of abrasion resulting from the sliding movement of both members 111 and 106, expansion and contraction of the seal member 112 due to variation in the internal pressure of the cylinders 107, and other reasons, the various members may be remarkably shortened in life.

Internal pressure of the cylinders 107 causes the sleeves 106 and the rotor 104 to be pushed toward the direction away from the cylinder port plate 111. Also, a radial pushing force acts on the right end side of the rotor 104 as viewed in FIG. 12 from the swash plate 122 via the shoes 121 and the pistons 108, causing the rotor 104 to tilt. This pushing force is due to reaction force of the radial component of a pushing force which receives from each piston 108 pushing the swash plate 122. In particular, the front end of the pressure plate 123 is supported by the main shaft 130, whereas its rear end fitted to the sleeves 106 with a clearance. Yet, there is a clearance between the main shaft 130 and the rotor 104. Accordingly, the rotor 104 tilts due to the aforementioned pushing force that acts on the fitting portion between the pressure plate 123 and the sleeves 106, the degree of the tilt being more than a permissible deflection of the main shaft 130. As a result, the rotor 104 will rotate while repetitively tilting, so that the gap between the rotor 104 and a stator 134 becomes nonuniform. This makes the rotation unstable, bringing about noise and vibration. Further, since the cylinders 107 are formed by providing a plurality of holes 105 to the rotor 104 that is formed of laminated steel sheets, each steel sheet constituting the rotor 104 needs to be provided with a through hole. This would involve troublesome machining and assembling work. Moreover, it is necessary to provide the sleeves 106 for sealing the cylinders 107 as well as the cylinder port plate 111 for forming the kidney-shaped port 110 and the pressure plate 123 for supporting both ends of the sleeves 106. This would involve an increased number of part items and unfavorably troublesome assembling work.

OBJECTS AND SUMMARY OF THE INVENTION

The object of the present invention is therefore to provide a fluid pressure generating device which can reduce noise and vibration and improve durability, and which is simple in construction and good in assemblability.

To achieve the above object, a fluid pressure generating device of the present invention comprises: a casing; a motor positioned in the casing and provided with a rotor having a fitting hole positioned at a center thereof; a cylinder block having a main shaft at a center thereof and a plurality of cylinders on an outer peripheral portion, wherein pistons are slidably mounted in said cylinders, each piston having a head portion on one side of the cylinders, and the cylinder block further having kidney-shaped ports on the other side of the cylinders opposite to the pistons; a piston actuator arranged opposite to the head portions and having an inclined surface on which the head portions or shoes retained by the head portions will slide; and a valve plate which is arranged opposite to one end portion of the cylinder block opposite to the piston side and which has a suction port and a discharge port communicating with a suction passage and a discharge passage, respectively, wherein the cylinder block is fixedly fitted to the fitting hole of the rotor and the main shaft is supported by a stationary member including the casing so that the rotor is rotatably supported by the stationary member via the cylinder block and the main shaft.

According to the above arrangement, the cylinder block is formed independently of the rotor of the motor, and fixedly fitted to the fitting hole of the rotor. Further, the main shaft of the cylinder block is supported by the stationary member, while the rotor is rotatably supported by the stationary member via the cylinder block and the main shaft. Thus, the fluid pressure generating device can be downsized effectively and improved in its assemblability. Also, since the needs for the sleeves and the cylinder port plate, which are necessitated in the prior art, can be eliminated, no noise or vibration will occur due to relative movement of the two members so that the device durability is improved. Besides, pump elements to be built up on the basis of the cylinder block can be formed as a structure performing an optimum pump function without being restricted by the motor construction, while the motor also can be in its optimum construction for its function. Yet, the bearings for supporting the rotor can be used also as the bearing structure for supporting the cylinder block, so that its construction can be simplified and accuracy of the device can also be improved. Further, since the axial center of the rotor is supported by the block, the gap between the rotor and the stator will not vary even if the rotor undergoes magnetic attracting force, so that the rotor is improved in stability of its rotation with reduced noise.

Preferably, the fluid pressure generating device has the following arrangement. That is, the cylinder block and the main shaft, formed of different members, are coupled with each other so as to be movable relatively to each other in the axial direction via a sliding bearing. The shoes retained by the head portions of the pistons are provided with a retainer. The main shaft is provided with an engaging portion for engagement with the retainer in a relatively rotatable manner. Between the cylinder block and the main shaft, an elastic member is provided for pressing the cylinder block against the valve plate and pressing the shoes against the inclined surface of the piston actuator via the main shaft and the retainer.

With the above arrangement, it is possible to make uniform the pressing force that presses the cylinder block against the valve plate and the shoes against the inclined surface of the piston actuator. Also, durability can be improved, compared with the arrangement that a spring is internally provided to each cylinder for pressing. Yet, since the cylinder block and the main shaft are coupled so as to be movable relative to each other, providing only one elastic member allows formation of the pressing structure that the cylinder block is pressed against the valve plate and the shoes are against the piston actuator, hence a simplified construction.

It is also preferable to arrange the fluid pressure generating device as follows. The cylinder block is supported by the main shaft of a member other than the cylinder block. A position where the cylinder block is supported by a shaft is on the piston actuator side further closer thereto than the cylinder opening end face of the cylinder block on the piston actuator side. Meanwhile, a cylindrical portion protruding on the piston actuator side even closer thereto than the aforementioned opening end face is provided to the cylinder block, the cylindrical portion being supported by the main shaft.

With the above arrangement, a radial component of the force that acts on the pistons from the inclined surface as a reaction force of the pressing force with which the pistons press the inclined surface of the piston actuator via the shoes is received at the supporting position via the cylindrical portion. Thus, the cylinder block and moreover the rotor can effectively be prevented from tiltedly rotating, so that the gap between stator and rotor of the motor is made uniform. As a result, the rotation of the motor becomes stable, so that noise and vibration can be reduced. Further, there will occur no clearance to the sliding surface between the cylinder block and the valve plate, so that no leak will occur. As a result, capacity efficiency will never be lower, and wear that may occur due to local contacts can also be avoided.

Further, it is desirable that the valve plate side end surface of the cylinder block protrudes outside the opening end face of the fitting hole of the rotor.

With the above arrangement, the portion of the cylinder block that protrudes from the fitting hole of the rotor can be made larger in diameter than the fitting hole, and accordingly the valve plate also can be made larger in diameter. Such enlargement in sliding area helps prevent the cylinder block from tiltedly rotating and from leaking.

Still further, it is preferable that the cylinder block comprises a piston stroke portion having a plurality of cylinders internally provided with a piston, and an extended portion extended axially with respect to the piston stroke portion and having a passage communicating with the cylinders, wherein the cylinder block is press secured to the fitting hole of the rotor only at the aforementioned extended portion.

With such an arrangement, while the rotor and the cylinder block can be easily fitted and secured, this piston stroke portion can be suppressed from any fitting distortion and prevented from any performance reduction.

Also, it is preferable that the aforementioned piston actuator is provided in the form of a swash plate having a trunnion shaft or cradle type swash plate, with its inclination angle variable.

With such an arrangement, the fluid pressure generating device can be downsized while the pump can also be controlled in capacity, so that a capacity-controllable, small-size fluid pressure generating device can be provided.

Another arrangement as described below is also preferable. The cylinder block and the main shaft are fixedly fitted to each other and the main shaft is rotatably supported to a stationary member. The shoes retained by the head portions of the pistons have a retainer, while the main shaft is provided with an engaging portion for engagement with the retainer so as to be rotatable relative to the retainer, in such a manner that the engaging portion is axially movable. The cylinder block is provided with a plurality of pushing pins extending toward the engaging portion. An elastic member for pressing the cylinder block against the valve plate and also pressing pushing pins so that the shoes are pressed against the inclined surface of the piston actuator is provided between the cylinder block and the pushing pins.

In this way, with the main shaft and the cylinder block fixedly fitted to each other, the clearance of the sliding portion is no longer needed, compared with the arrangement wherein the main shaft and the cylinder block are movable relative to each other in the axial direction via the aforementioned sliding bearing. Instead, only the clearance of the bearings for supporting the main shaft is required so that the tilt of the cylinder block and moreover that of the rotor can be minimized, with its precision improved.

Still another arrangement is also preferable. That is, the cylinder block and the main shaft are formed integrally with each other and the main shaft is rotatably supported to a stationary member. Further, between the cylinder block and the pistons, an elastic member is provided for pressing the cylinder block against the valve plate and pressing the head portions of the pistons or the shoes retained by the head portions against the inclined surface of the piston actuator.

In this way, with the main shaft formed integrally with the cylinder block, not only the number of part items can be reduced but also high precision can be expected, compared with the case in which the main shaft is coupled with the cylinder block as a separate member.

Further, it is also preferable that the main shaft and the cylinder block are fixedly fitted to each other, the main shaft is rotatably supported to the stationary member, and that a protruding shaft is provided on at least one axial end side of the main shaft so as to protrude outward of the outer surface of the casing.

In this way, with the main shaft equipped with a protruding shaft that protrudes outward of the outer surface of the casing, the protruding shaft can be utilized as a power take-out shaft, so that the fluid pressure generating device can be available more widely.

Also, preferably, the protruding shaft and the cooling fan are coupled in the above arrangement.

Then, it is possible to implement air cooling.

Moreover, it is preferable that the casing is of a closed structure, and that a fluid suction port that opens to an internal space of the casing is provided on one axial end side relative to the motor which is contained in the casing while a suction port passage, one end of which opens to the internal space of the casing and the other end of which opens to a suction port of the valve plate, is provided on the other axial end side relative to the motor.

With the above arrangement, the sucked fluid can be utilized to cool the motor and the pump.

Further, it is preferable that the casing is of closed structure and is provided with a suction passage and a discharge passage communicating with a suction port and a discharge port, respectively, of the valve plate, and that a fluid inlet port and a fluid outlet port that open to an internal space of the casing and communicate with the fluid reservoir are provided, one axial side and the other axial side, respectively, relative to the motor which is contained in the casing, while fluid feed means for generating fluid flow from the fluid inlet port to the fluid outlet port is provided to the rotor and/or the cylinder block.

With the above arrangement, a fluid flow of a system other than the suction passage system can be generated in the casing by the aforementioned fluid feed means provided to the motor and/or the cylinder block, so that the motor can be cooled. At the same time, fluid is sucked into the cylinders from the suction passage of the different system while the fluid that has served to cool the motor is not sucked. Thus, the disadvantage that contaminations such as wear chips are sucked at the time of motor cooling can be solved. Also, even if the piston actuator is adjusted to the neutral position, the motor cooling can be effected so far as the motor is driven.

Further, it is preferable that a magnet is installed within the casing.

With such an arrangement, it is possible to attract any foreign matters such as wear chips by the magnet, so that the motor and the pump can be prevented from any performance deterioration and damage.

BRIEF DESCRIPTION OF TEE DRAWINGS

BEST MODE FOR CARRYING OUT THE INVENTION

Figure 1:
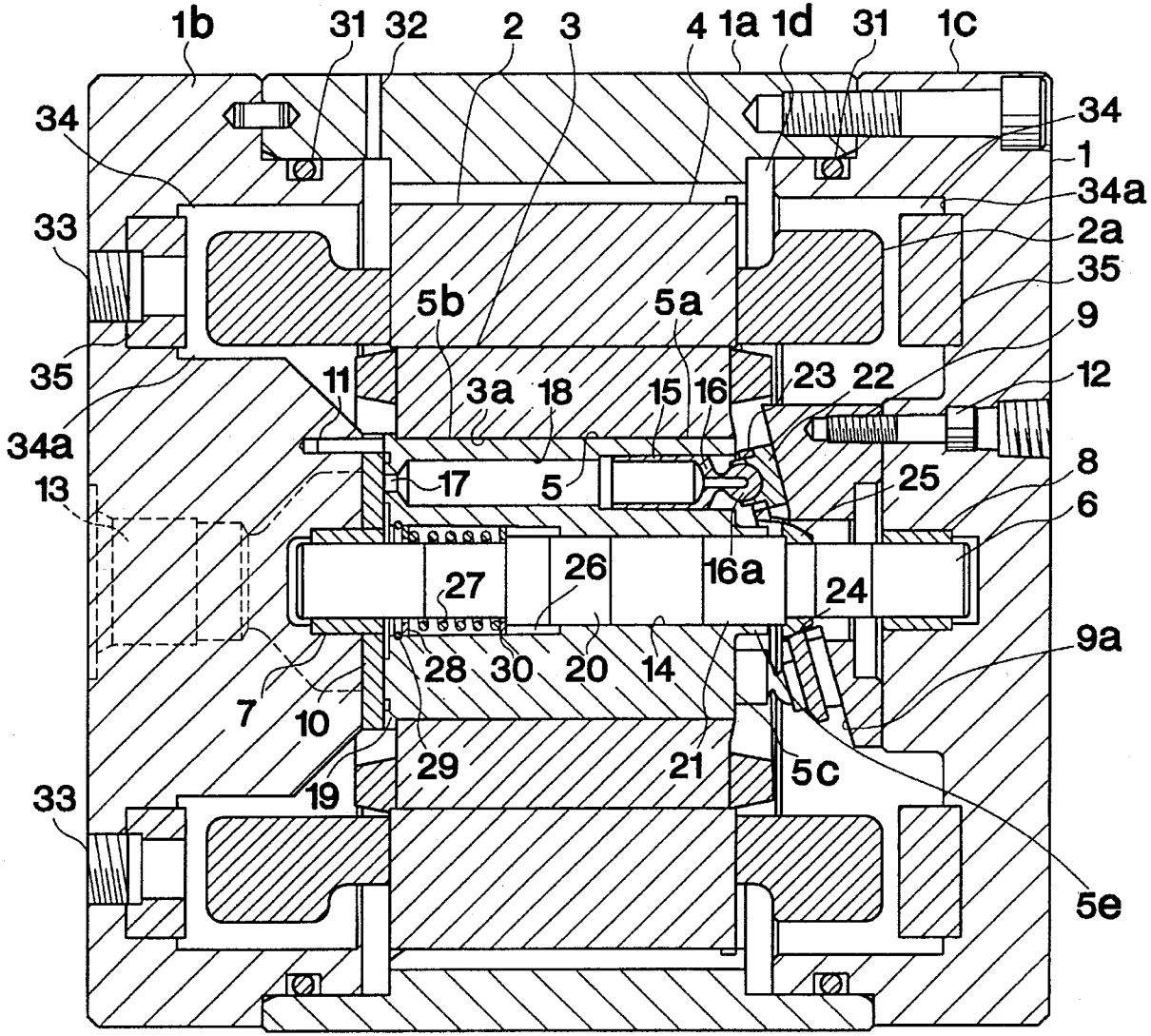
FIG. 1 is a longitudinal sectional view showing a first embodiment of the fluid pressure generating device according to the present invention.

The first embodiment as shown in FIG. 1 illustrates the basic structure of the invention device. The device comprises a barrel casing 1*a* and a pair of cover plates 1*b*, 1*c*, and has a motor 4, which comprises a stator 2 and a rotor 3, within an internal space 1*d* of a casing 1 of closed structure. A fitting hole 3*a* is provided at the center of the rotor 3, to which fitting hole 3*a* a cylinder block 5 which will be described below is press fitted. A main shaft 6 provided at the center of the cylinder block 5 is supported by the cover plates 1*b*, 1*c* of the casing 1 via bearings 7, 8 formed, for example, of a needle bearing. In this way, the rotor 3 is rotatably supported to the casing 1 via the cylinder block 5 and the main shaft 6. Further, a piston actuator 9 having an inclined surface 9*a* is provided on one axial side of the cylinder block 5, while a valve plate 10 having a suction port and a discharge port both of a kidney-shape, which communicate with a suction passage and a discharge passage, respectively, is provided on the other side of the cylinder block 5.

The cover plates 1*b*, 1*c* of the casing 1 are provided at its center with a protrusion that protrudes into the internal space 1*d*. To the protrusion portion of the cover plate 1*b*, the bearing 7 is provided at its center. To sandwich this bearing 7, the suction passage and the discharge passage are provided on radial opposite sides of the cover plate 1*b*. Further, the valve plate 10 is attached inside the protrusion via a fixing pin 11. Meanwhile to the protrusion of the cover plate 1*c*, the bearing 8 is provided at its center, and the piston actuator 9 is attached to the inside via a fixing screw 12.

It is to be noted that only the suction passage is shown by dotted line and denoted by numeral 13 in FIG. 1, but the discharge passage also is formed in the same way as the suction passage 13.

The cylinder block 5 is formed of members other than of the main shaft 6 and is of a cylindrical shape having a shaft hole 14 at its center. The wall thickness portion of the cylinder block 5 is provided with a plurality of cylinders 15, into each of which cylinders 15 a piston 16 having a spherical head portion 16*a* on its one side is slidably fitted. One side of each cylinder 15 is closed by the piston 16, while the other side thereof, i.e. its counter-piston side is open. To this open side, a kidney-shaped port 17 is formed so as to oppose the valve plate 10. The sectional area of this kidney-shaped port 17 is smaller than that of the cylinders 15.

Also, the cylinder block 5 comprises a piston stroke portion 5*a* through which the pistons 16 reciprocate, i.e. which defines the cylinders 15 and contains the pistons 16 so as to allow the pistons 16 to be slidable, and an extended portion 5*b* which extends axially with respect to the piston stroke portion 5*a* and which has a passage 18 communicating with the cylinders 15. The axial length of the cylinder block 5 is approximately equal to the axial length of the rotor 3. The kidney-shaped port 17 is provided on the open side of the aforementioned passage 18 of the extended portion 5*b*.

Further, in the cylinder block 5 of the embodiment shown in FIG. 1, on the outer periphery of the counter-piston side end of the extended portion 5*b* is provided a stopper portion 19 having a diameter larger than the outer diameter of the cylinder block 5. The outer diameter of the piston stroke portion 5*a* is smaller than the outer diameter of the extended portion 5*b*, so that the cylinder block 5 is press fitted into the fitting hole 3*a* of the rotor 3 at the extended portion 5*b* so as to be coupled with each other. In this case, the piston stroke portion 5*a* will never be affected by the press fitting, so that the cylinders 15 can be reduced in distortion due to advantageously press fitting.

Further, the main shaft 6, which is formed independently of the cylinder block 5, is provided with sliding bearings 20, 21, via which the cylinder block 5 and the main shaft 6 are coupled with each other so as to be movable relative to each other in the axial direction. The sliding bearing 21 is positioned outside the cylinder open end face 5*c* on the piston actuator side, i.e. on the side to be closed by the pistons 16, of the cylinder block 5, i.e. positioned on the piston actuator side. At the same time, the cylinder block 5 is provided with a cylindrical portion 5*e* that protrudes on the piston actuator side closer thereto than the open end face 5*c*. The cylinder block 5 is supported via the cylindrical portion 5*e* by the sliding bearing 21 located at the cylindrical portion 5*e*. Thus, a radial component of the force that acts on the pistons 16 as a reaction force of the liquid pressure thereof from the inclined surface 9*a* of the piston actuator 9 is received, so that this radial component is prevented from acting to tilt the cylinder block 5.

Further, since the kidney-shaped port with its section area smaller than that of the cylinders 15 is provided, the cylinder block 5 is forcedly pressed against the valve plate 10 by internal pressure of the cylinders 15, so that the cylinder block 5 is prevented from tiltedly rotating.

In this way, since the cylinder block 5 will not tiltedly rotate, the rotor 3 will not tilt either so that its gap to the stator 2 becomes uniform, with rotating force and magnetic attracting force balanced. Besides, the alignment action by the liquid film present in the gap is also balanced, so that rotation of the rotor 3 and the cylinder block 5 becomes stable. As a result, noise and vibration can be reduced. Further, since the cylinder block 5 will never tilt, it will have no clearance to the sliding surface with the valve plate 10, causing no leaking. As a result, its capacity efficiency will be lower, and wear due to local contacts will not occur.

At the head portions 16*a* of the pistons 16, shoes 22 having a sliding surface for sliding movement on the inclined surface 9*a* of the piston actuator 9 are retained. Each shoe 22 is retained by a retainer 23. With an engaged portion 24 provided at the center of the retainer 23 and having a spherical inner surface, an annular engaging portion 25 provided to the main shaft 6 and having a spherical outer surface is engaged so as to be rotatable relative thereto. At the shaft hole 14 of the cylinder block 5, a large-diameter portion is provided on its side of the extended portion 5*b*. In an annular space 26 formed between the inner peripheral surface of the large-diameter portion and the outer peripheral surface of the main shaft 6, an elastic member 27 comprised of a coil spring is provided. One lengthwise end side of the elastic member 27 is engaged with the cylinder block 5 via a spring holder 28 and a stop ring 29. The other end side of the elastic member 27 is engaged with the stepped portion of the main shaft 6 via a spring holder 30. The cylinder block 5 is pressed against the valve plate 10, while the shoes 22 are pressed against the inclined surface 9*a* of the piston actuator 9 via the main shaft 6, the engaging portion 25, and the retainer 23, so that the cylinder block 5 will not be moved away from the valve plate 10, or that the shoes 22 will not be moved away from the inclined surface 9*a*.

In addition, referring to FIG. 1, 31 and a pull-out hole 32 for pulling out a lead wire from a coil end 2*a* of the stator 2, are provided and a terminal panel (not shown) is installed close to the pull-out hole 32.

Further, a hexagonal socket head plug 33 is provided to the cover plate 1*b*, an accommodating space 34 of the coil end 2*a* is formed around the protrusion of the cover plates 1*b*, 1*c*. The accommodating space 34 has an opposing inner surface opposed to the coil end 2*a*. An annular magnet 35 is mounted to the opposing inner surface 34*a* so as to oppose the coil end 2*a*, so that foreign matters such as wear chips floating in the internal space 1*d* of the casing 1 are attracted and thus prevented from sticking to the coil end 2*a*.

The operation of the embodiment as shown in FIG. 1 is as follows. With the coil of the stator 2 powered, the rotor 3 rotates while the cylinder block 5 secured to the rotor 3 rotates on the main shaft 6 via the sliding bearings 20, 21.

When this occurs, there are some cases in which the main shaft 6 is held stationary, but in many cases it rotates together with the cylinder block 5 due to the intervention of the bearings 7, 8.

Then, the rotation of the cylinder block 5 causes the pistons 16 to rotate while sliding on the inclined surface 9*a* of the piston actuator 9 via the shoes 22. This rotation makes the pistons 16 reciprocate within the cylinders 15. Forward movement of this reciprocation causes the fluid to be sucked into the cylinders 15 from the kidney-shaped port 17 via the suction passage 13 and the suction port of the valve plate 10 (not shown). Return movement of the reciprocation pressurizes the sucked fluid, and the pressurized fluid is forcedly discharged to the discharge passage from the discharge port of the valve plate 10 (not shown) via the kidney-shaped port 17. This cycle will be repetitively effected.

In this cycle, the rotor 3 is supported to the main shaft 6 via the cylinder block 5 and the sliding bearings 20, 21. Thus, the axial center portion of the rotor 3 is supported by the cylinder block 5, so that the magnetic attracting force that acts on the rotor 3 is supported by the cylinder block 5 at the axial center portion of the fitting hole 3*a* of the rotor 3.

Accordingly, the gap between the rotor 3 and the stator 2 will not vary so that the rotation of the rotor 3 will be stable. Moreover, the radial component of the reaction force of the liquid pressure force that acts on the pistons 16 from the inclined surface 9*a* of the piston actuator 9 is received by the bearing 21 positioned on the piston actuator 9 side closer thereto than the cylinder open end face 5*c*, so that the cylinder block 5 and the rotor 3 are allowed to rotate with high stability without tilting. As a result, noise or vibration will not be generated. Also, the cylinder block 5 is fixedly fitted to the fitting hole 3*a* of the rotor 3, and the rotor 3 is rotatably supported to the bearings 7, 8 provided to the casing 1 via the cylinder block 5 and the main shaft 6. As a result, the bearing of the rotor 3 can be shared by the bearing structure of the cylinder block 5, so that the processing of assembling the cylinder block 5 to the rotor 3 can be easily done.

Yet, in the embodiment of FIG. 1, the end face of the cylinder block 5 on the valve plate 10 side protrudes from the end face of the rotor 3 on the valve plate 10 side, and the portion of the cylinder block 5 which portion protrudes from the fitting hole 3*a* of the rotor 3 toward the valve plate 10 is made larger in diameter than the fitting hole 3*a*. Thus, the sliding surface of the cylinder block 5 with the valve plate 10 can be made larger, and area of the valve plate 10 can be also made larger. As a result, the sliding area of the valve plate 10 can be enlarged so that the cylinder block 5 can be prevented from tiltedly rotating and from any leaking. That is, the size of the valve plate 10 can be designed to any unrestricted one irrespectively of the size of the fitting hole 3*a* of the rotor 3, so that the pump performance can be improved accordingly.

Further, the cylinder block 5 and the main shaft 6 are coupled with each other so as to be movable relative to each other in the axial direction via the sliding bearings 20, 21. Thus, only by using the one elastic member 27, it is made possible to press the cylinder block 5 against the valve plate 10 and to press the shoes 22 against the inclined surface 9*a* of the piston actuator 9 via the retainer 23 and the engaging portion 25. As a result, the pressing structure can be simplified, while the pressing can be made uniform. Also, because of the use of the single elastic member 27, the device construction becomes simple and spring fatigue can be lessened and durability can also be improved, compared with the case where each cylinder is internally equipped with a spring.

Next referring to FIGS. 2 through 11, modifications of the first embodiment shown in FIG. 1 will be described below.

It is to be noted that in FIGS. 2 through 11, like parts as in FIG. 1 are designated by like numerals, and that description of these parts is omitted and only differences will be described.

Figure 2:
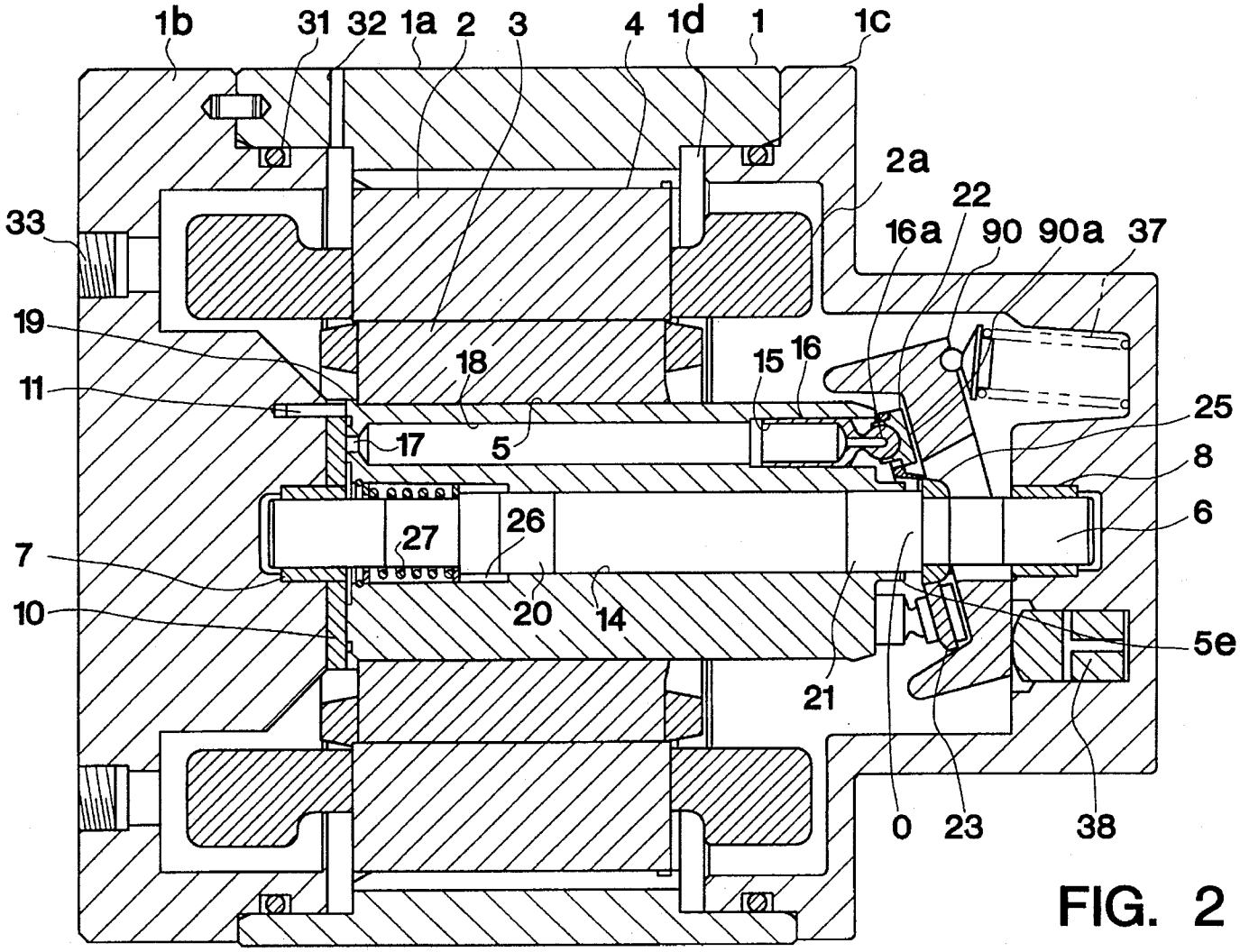
FIG. 2 is a longitudinal sectional view showing a second embodiment of the present invention.
Figure 3:
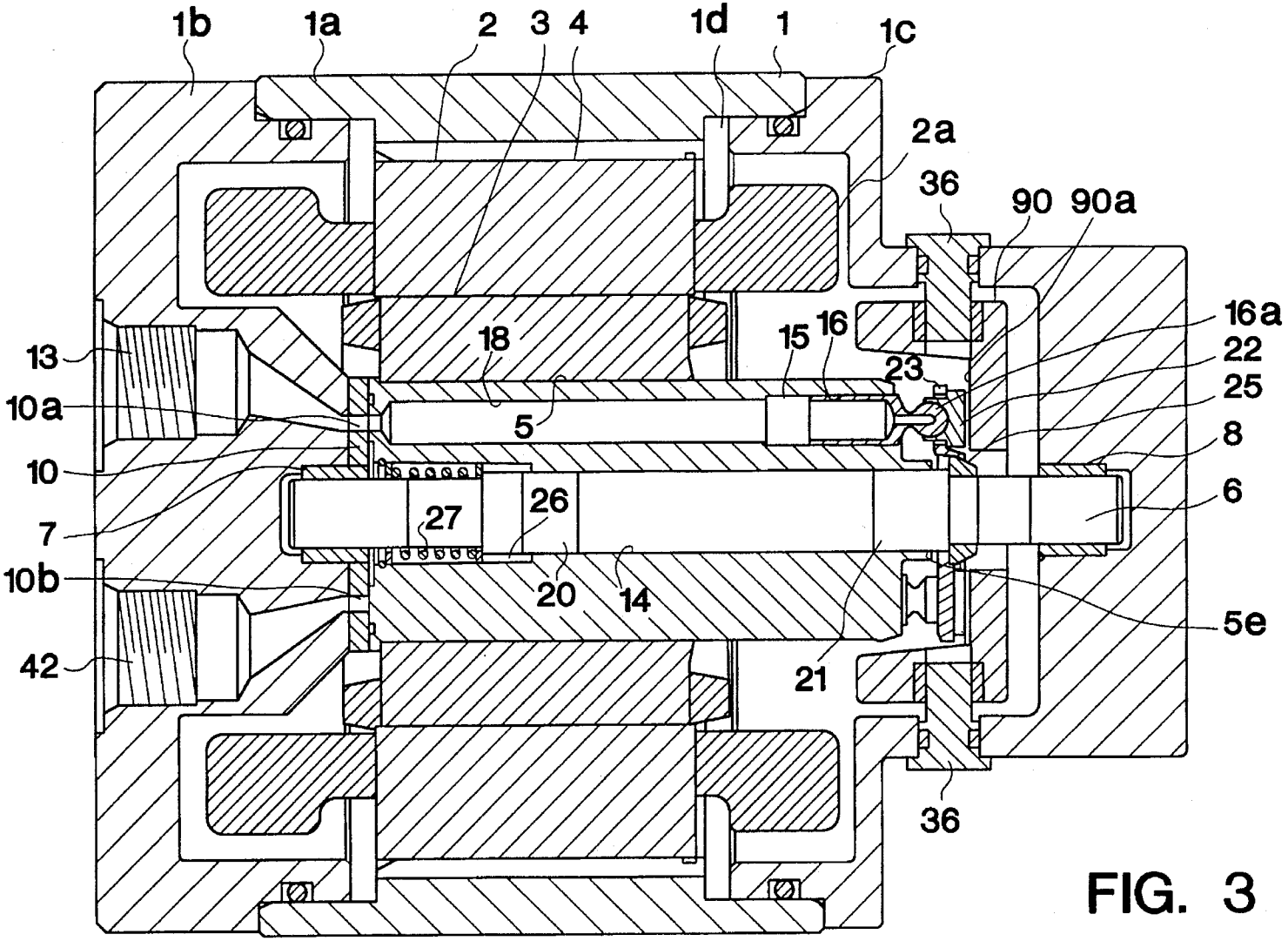
FIG. 3 is a transverse sectional view of the second embodiment of the present invention.

A second embodiment of the invention, as shown in FIGS. 2 and 3, is so arranged that instead of the piston actuator 9 that has been fixed in FIG. 1, a swash plate 90 having a trunnion shaft 36 is used to provide a piston actuator, the inclination angle of the inclined surface 90*a* of the swash plate 90 being made variable via the trunnion shaft 36.

The trunnion shaft 36 is rotatably supported to the cover plate 1*c* as shown in FIG. 3. Besides, on the rear side of the swash plate 90 is provided a spring, see FIG. 2, for biasing the swash plate 90 toward the maximum inclined angle direction and an operating plunger 38 for hydraulic control to adjust the swash plate 90 to the direction of the neutral position.

Figure 4:
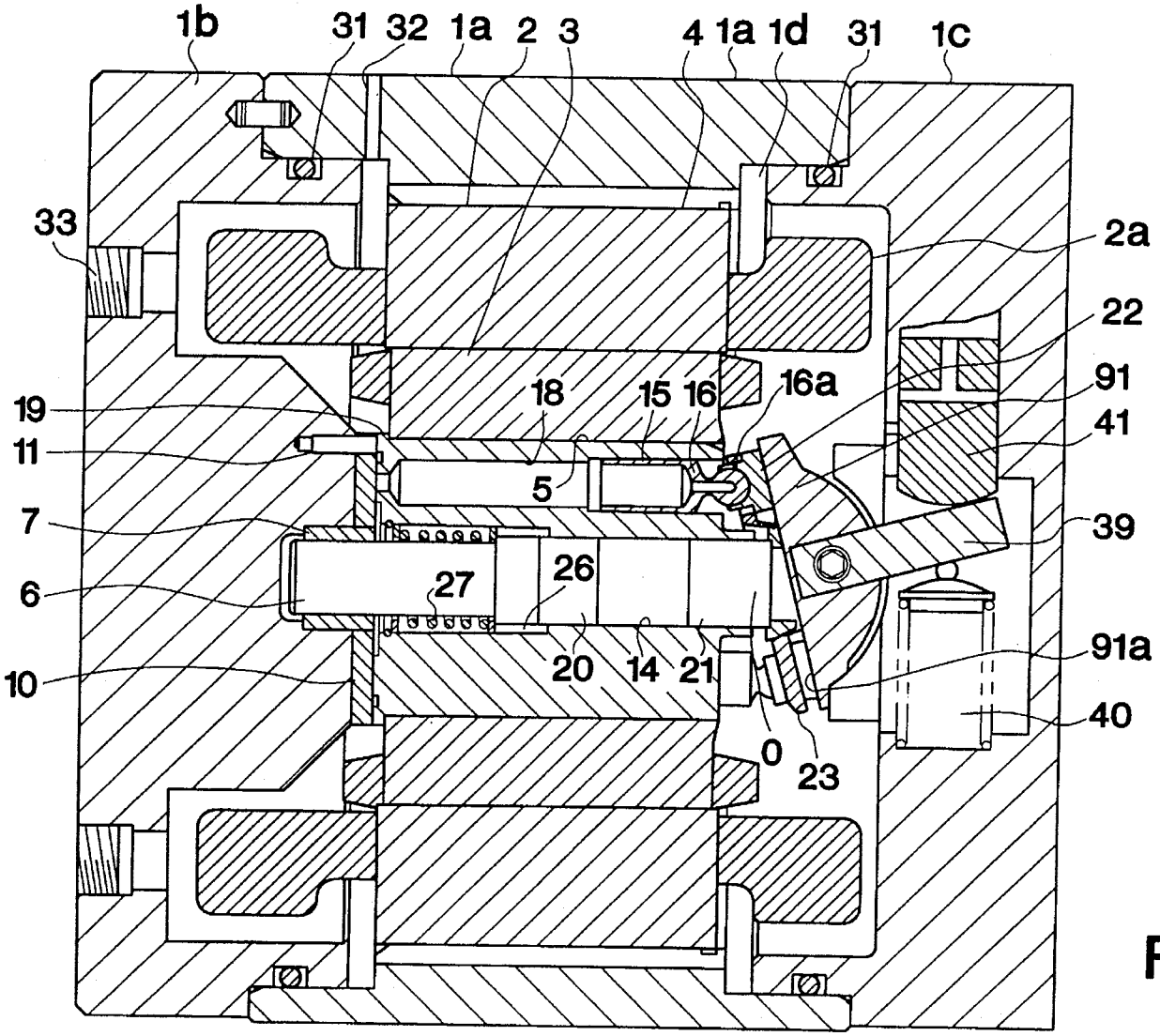
FIG. 4 is a longitudinal sectional view showing a third embodiment of the present invention.
Figure 5:
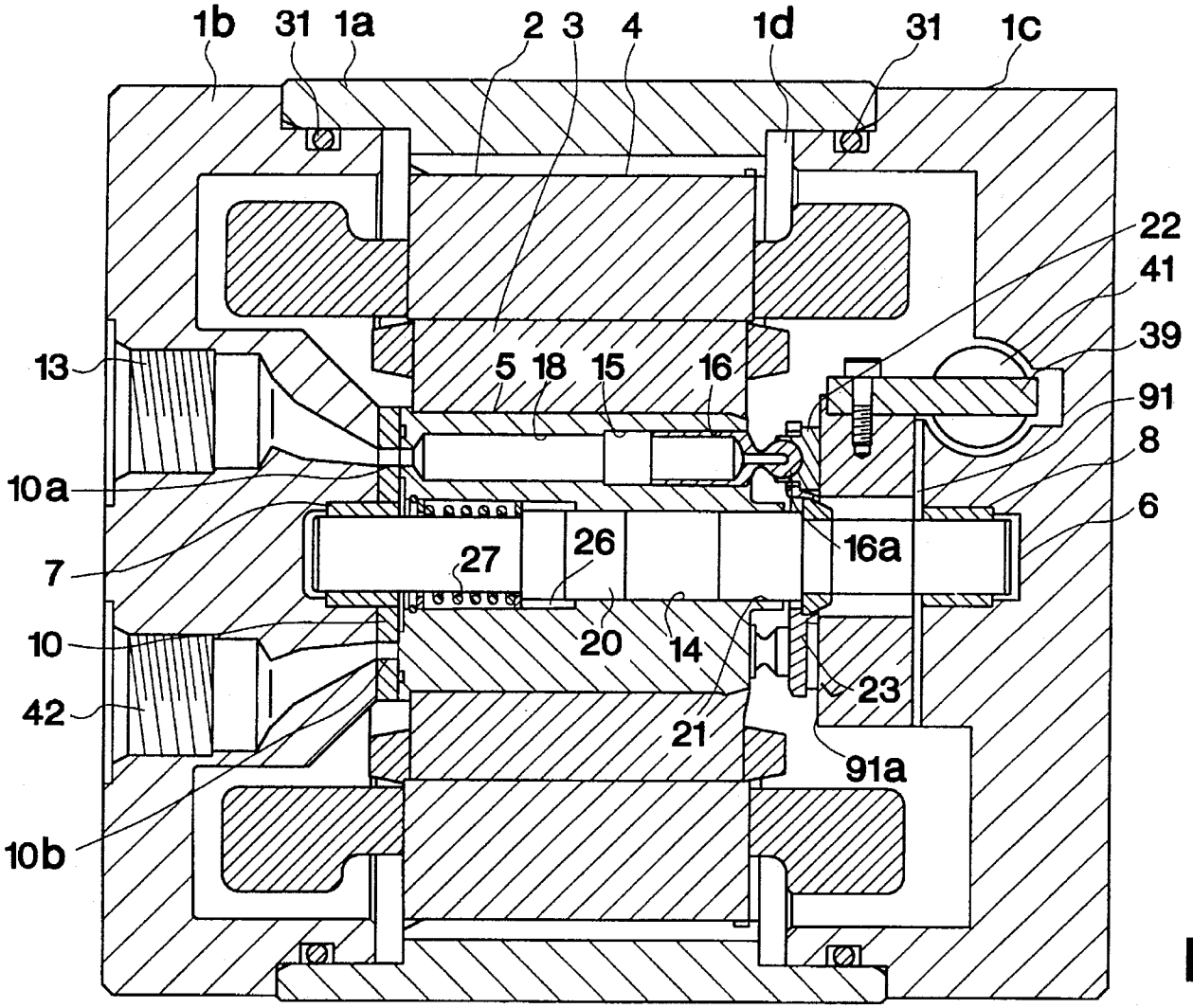
FIG. 5 is a transverse sectional view of the third embodiment of the present invention.

A third embodiment of the invention as shown in FIGS. 4 and 5 is so arranged that instead of the piston actuator 9 as shown in FIG. 1, a cradle type swash plate 91 having an arched surface on its rear side and also having an operating piece 39 is provided, wherein the inclination angle of the inclined surface 91*a* of the swash plate 91 being made variable by means of the arched surface.

The operating piece 39, extending toward the rear of the swash plate 91, has a spring 40 provided on one side of its extended end portion for biasing the swash plate 91 toward the maximum inclination angle direction, and an operating plunger 41 provided on the other side for hydraulic control to adjust the swash plate 91 to the direction of the neutral position.

In the second and third embodiments as shown in FIGS. 2 through 5, the axial center line O of the trunnion shaft 36 passes the center of the main shaft 6 or the rotational center O of the cradle type swash plate 91 is positioned at the axial center of the main shaft 6. Thus, the operability in adjusting the inclined angle of the swash plates 90, 91 by the operating plungers 38, 41 is improved.

Also, in FIGS. 2 and 3, the cylinder block 5 protrudes at its piston side outward of the end face of the rotor 3. In this case, the trunnion shaft 36 is provided outside the coil end 2*a*. Instead, it is also possible to provide the trunnion shaft 36 by utilizing the radial inner space of the coil end 2*a*.

In either case, by making the piston actuator 9 variable in its inclination angle, capacity control of a fluid pressure generating device becomes possible and thus the device capable of capacity control can be obtained. In addition, in FIGS. 3 and 5, numeral 42 denotes the discharge passage and 10*a* and 10*b* denote the kidney-shaped suction port and discharge port, respectively, provided to the valve plate 10.

Figure 6:
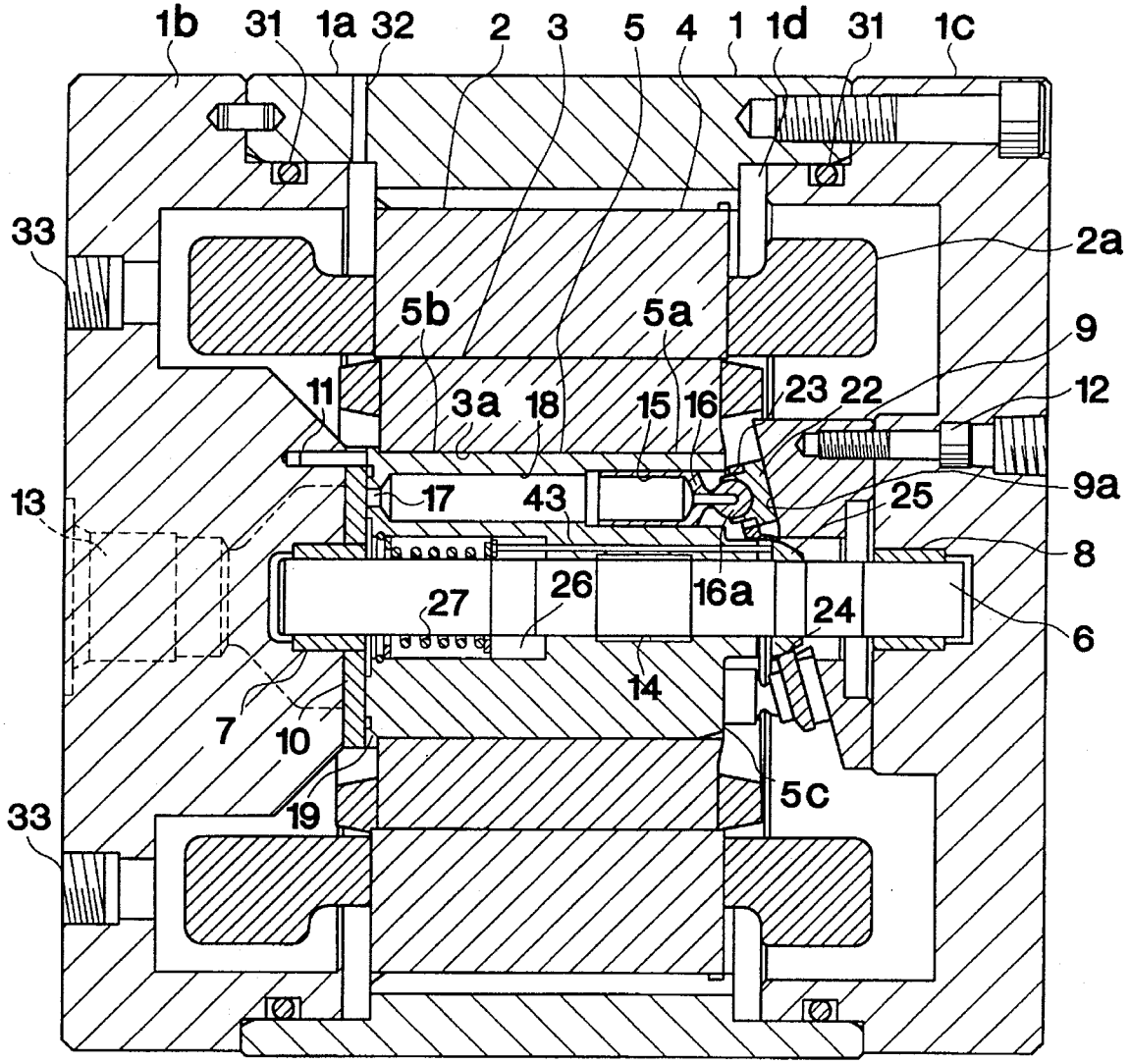
FIG. 6 is a longitudinal sectional view showing a fourth embodiment of the present invention.

Next a fourth embodiment of the invention shown in FIG. 6 is described below.

The fourth embodiment as shown in FIG. 6 is provided in the following construction. The main shaft 6, which is formed of a member other than of the cylinder block 5 and press fitted integrally therewith, is rotatably supported to the casing 1 via the bearings 7, 8. The engaging portion 25 to be relatively rotatably engaged with the retainer 23 is provided to the main shaft 6 so as to be movable in the axial direction. The cylinder block 5 is provided with a plurality (e.g. three) of pushing pins 43 that pass through the cylinder block 5 from an annular space 26 formed between the shaft hole 14 of the cylinder block 5 and the outer peripheral surface of the main shaft 6 and that extend toward the engaging portion 25. The annular space 26 is provided with an elastic member 27 comprised of a coil spring as in the first embodiment. The cylinder block 5 is pressed against the valve plate 10 via the elastic member 27 and the pushing pins 43 while the shoes 22 are pressed against the inclined surface 9*a* of the piston actuator 9 via the pushing pins 43 and the retainer 23. Thus, the cylinder block 5 will not be moved away from the valve plate 10 or the shoes 22 will not be moved from the inclined surface 9*a*.

When the main shaft 6 and the cylinder block 5 are press fitted to each other integrally as described above, there will be no need for clearances at the sliding bearings 20, 21, compared with the case where the main shaft 6 and the cylinder block 5 are coupled with each other via sliding bearings 20, 21 as in the first embodiment. Instead, rotational clearances at the bearings 7, 8 are only required, so that the inclination of the cylinder block 5 and therefore the inclination of the rotor 3 can be lessened. Accordingly, the accuracy of the device can be improved.

Figure 7:
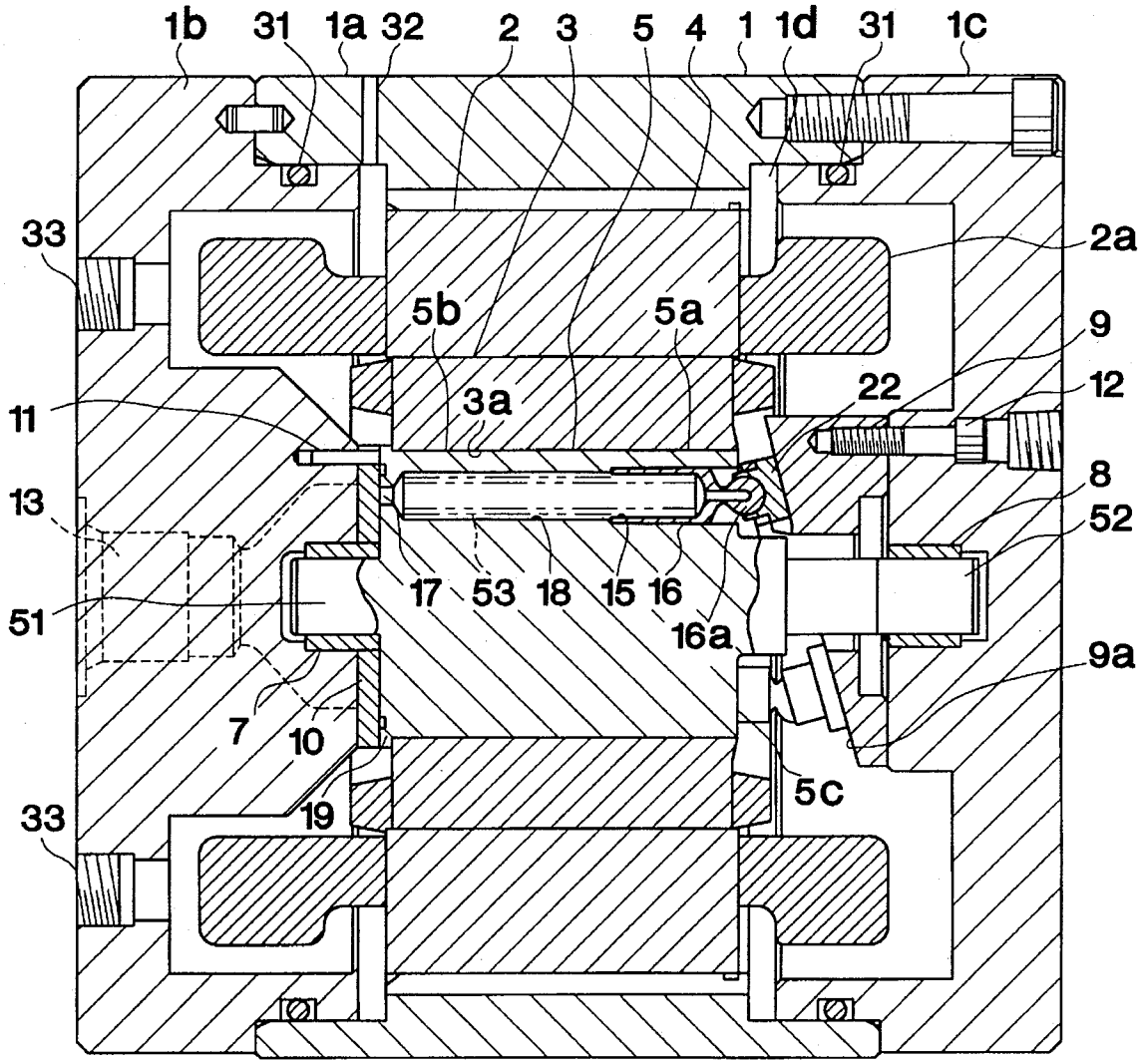
FIG. 7 is a longitudinal sectional view showing a fifth embodiment of the present invention.

Also, the fifth embodiment as shown in FIG. 7 is such that the cylinder block 5 and the main shaft 6 are formed integrally with each other.

More specifically, a left-hand main shaft 51 and a right-hand main shaft 52 are integrally protrudingly formed from both axial end faces of the cylinder block 5. In this arrangement, the pressing of the cylinder block 5 against the valve plate 10 and the pressing of the shoes 22 against the inclined surface 9*a* are implemented in the following way. That is, an elastic member 53 comprised of a coil spring is provided within each cylinder 15. One end side of the elastic member 53 is engaged with a stepped portion forming the kidney-shaped port 17 while the other end side is engaged with the rear side of the pistons 16, so that the cylinder block 5 is pressed against the valve plate 10 and that the shoes 22 are pressed against the inclined surface 9*a*.

In this way the main shaft 6 is formed integrally with the cylinder block 5, whereby the main shaft 6 does not need to be provided separately. Thus, the number of part items can be reduced in proportion thereto, the assemblability can be improved, and the accuracy of the device can be improved.

Figure 8:
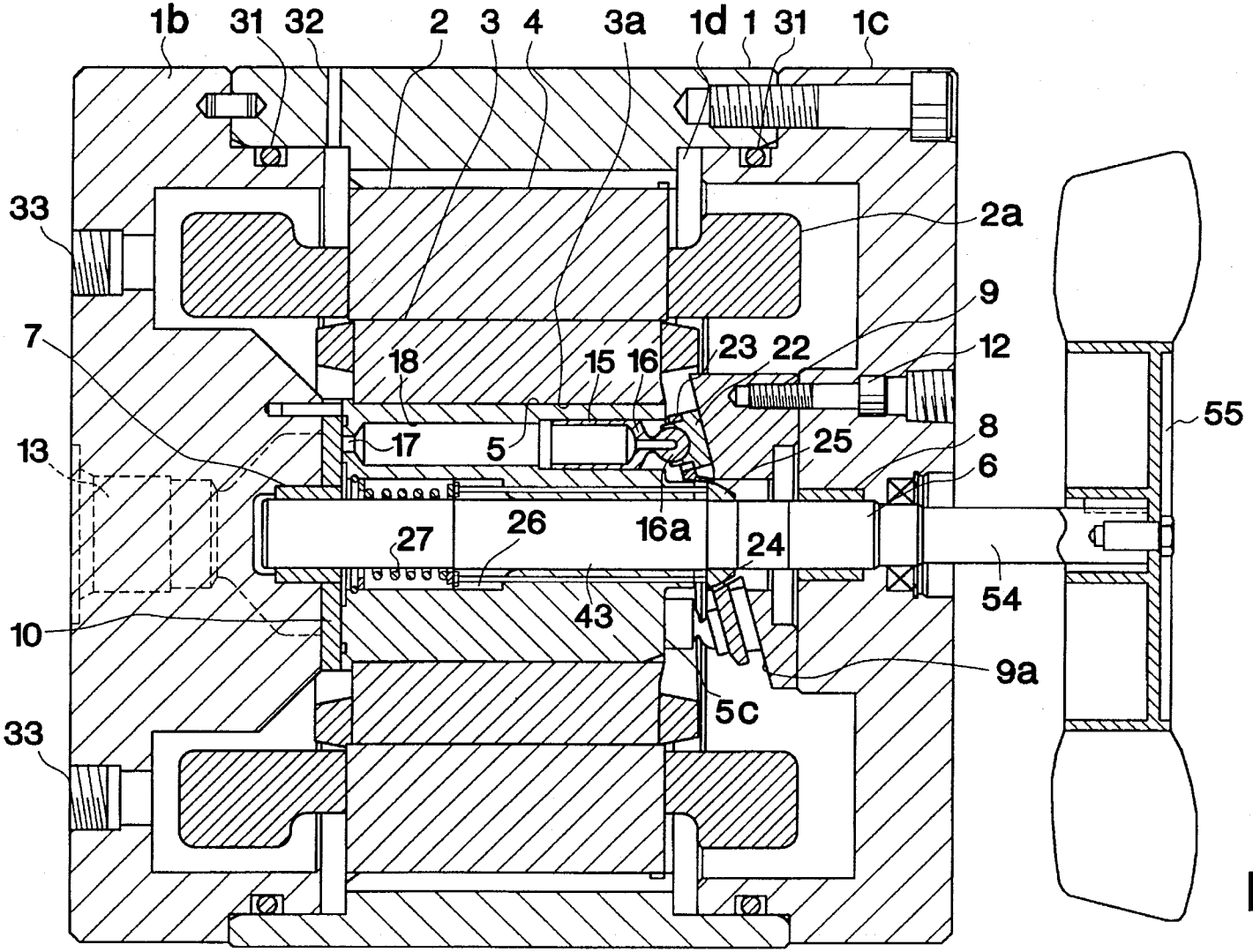
FIG. 8 is a longitudinal sectional view showing a sixth embodiment of the present invention.

Also, the sixth embodiment as shown in FIG. 8 provides a structure wherein the main shaft 6 of the fourth embodiment as shown in FIG. 6 protrudes outward of the cover plate 1*c* of the casing 1, and that this protruding shaft 54 is made to serve as the power take-out shaft (PTO shaft). In this sixth embodiment, a cooling fan 55 is coupled with the protruding shaft 54.

In this way, the provision of the protruding shaft 54 allows the coupling of the cooling fan 55, or although not shown in the drawings, the coupling of an auxiliary pump, so that the device can be widened in availability. Further, the coupling of the cooling fan 55 realizes air cooling of the casing 1.

In addition, in providing the protruding shaft 54, it may be located at the right-hand main shaft 52 of the fifth embodiment as shown in FIG. 7, without being limited to the location at the main shaft 6 as shown in the fourth embodiment of FIG. 6. Further, although not shown, the sliding bearings 20, 21 of the first embodiment as shown in FIG. 1 may be replaced with spline coupling, in which case the protruding shaft 54 is provided to the main shaft 6 that is spline coupled with the cylinder block 5.

Figure 9:
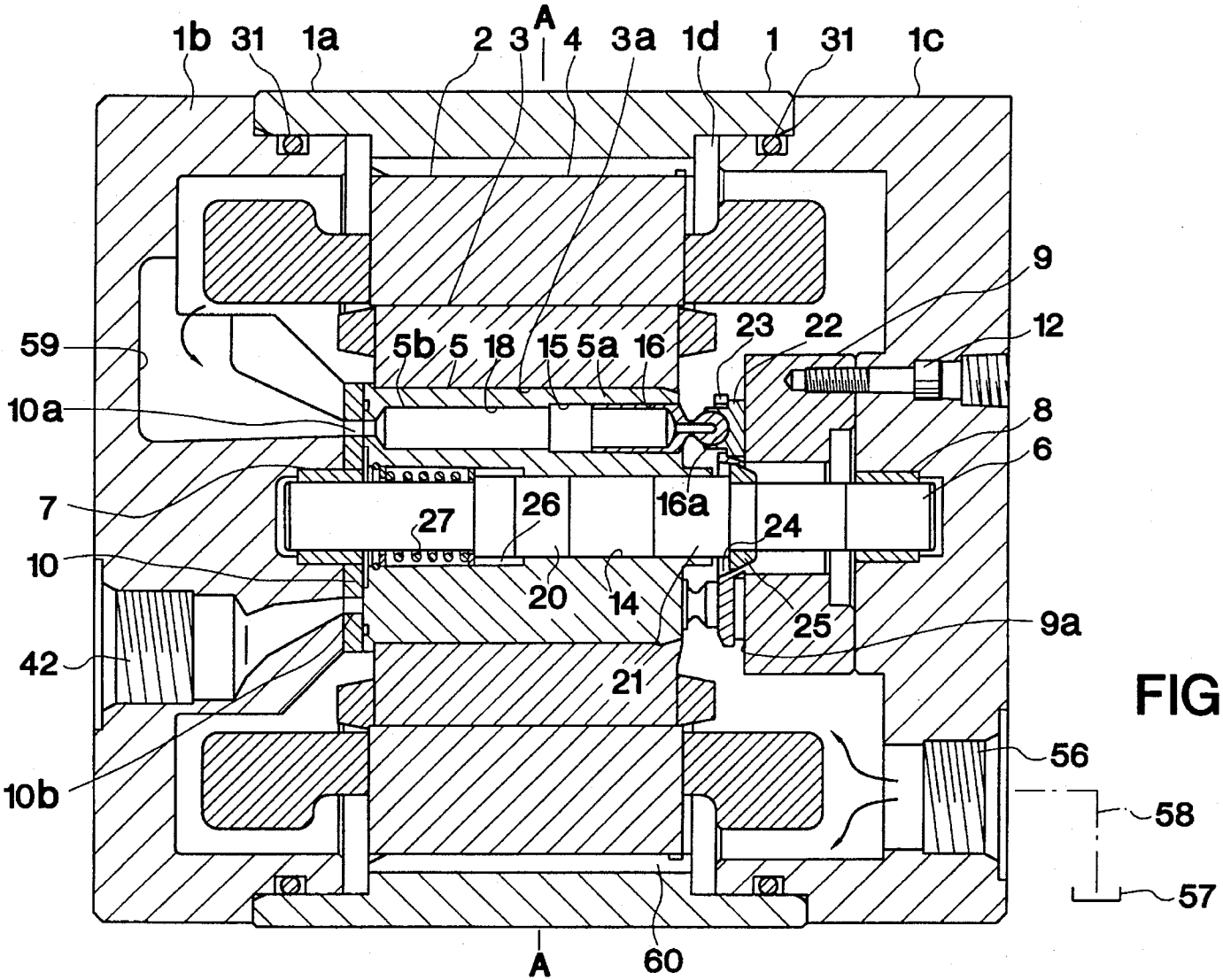
FIG. 9 is a longitudinal sectional view showing a seventh embodiment of the present invention.

Furthermore, a seventh embodiment of the invention as shown in FIG. 9 is such that fluid is sucked into the internal space 1*d* of the casing 1 which is constructed of a closed structure, so that the motor 4 can be cooled. A fluid inlet port 56 that opens to the internal space 1*d* is provided one axial side relative to the motor 4 contained in the casing 1, i.e. provided to the cover plate 1*c*. This inlet port 56 is connected with a suction tube 58 communicating with a fluid reservoir 57. On the other axial side relative to the motor 4, i.e. to the cover plate 1*b*, there is provided a suction passage 59 one end of which opens to the internal space 1*d* and the other end of which opens to the suction port 10*a* of the valve plate 10. By the reciprocating movement of the pistons 16 driven by the motor 4, the fluid in the fluid reservoir 57 is first sucked to one side of the internal space 1*d* from the inlet port 56, and flowed from the one side toward the other side of the internal space 1*d* through the gap between the stator 2 and the rotor 3 as well as the gap between a core cut 2*b* provided to the outer peripheral surface of the stator 2 and the inner peripheral surface of the barrel casing 1*a*. In this way the motor 4 is cooled and the fluid that has served for motor cooling is sucked into the cylinders 15 from the suction passage 59 through the suction port 10*a*.

In this case, since the motor cooling can be done by making use of the sucked fluid, a special arrangement for motor cooling is not required, so that the device construction can be simplified accordingly to an advantage.

Figure 10:
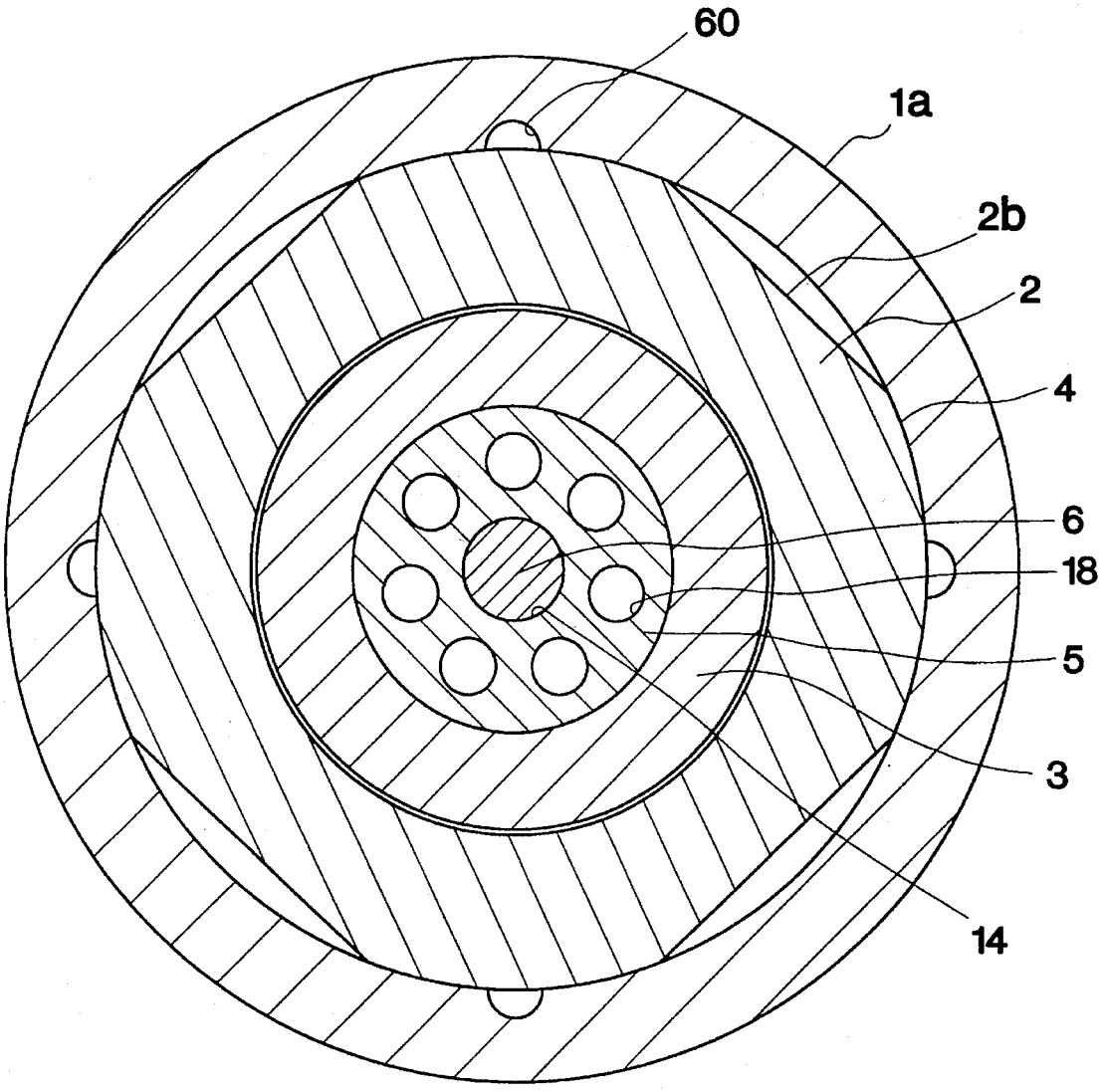
FIG. 10 is a sectional view taken along the line A—A of FIG. 9.

In addition, as shown in FIG. 10 in the embodiment of FIG. 9, a fluid distribution groove 60 may be provided to the barrel casing 1*a*.

Figure 11:
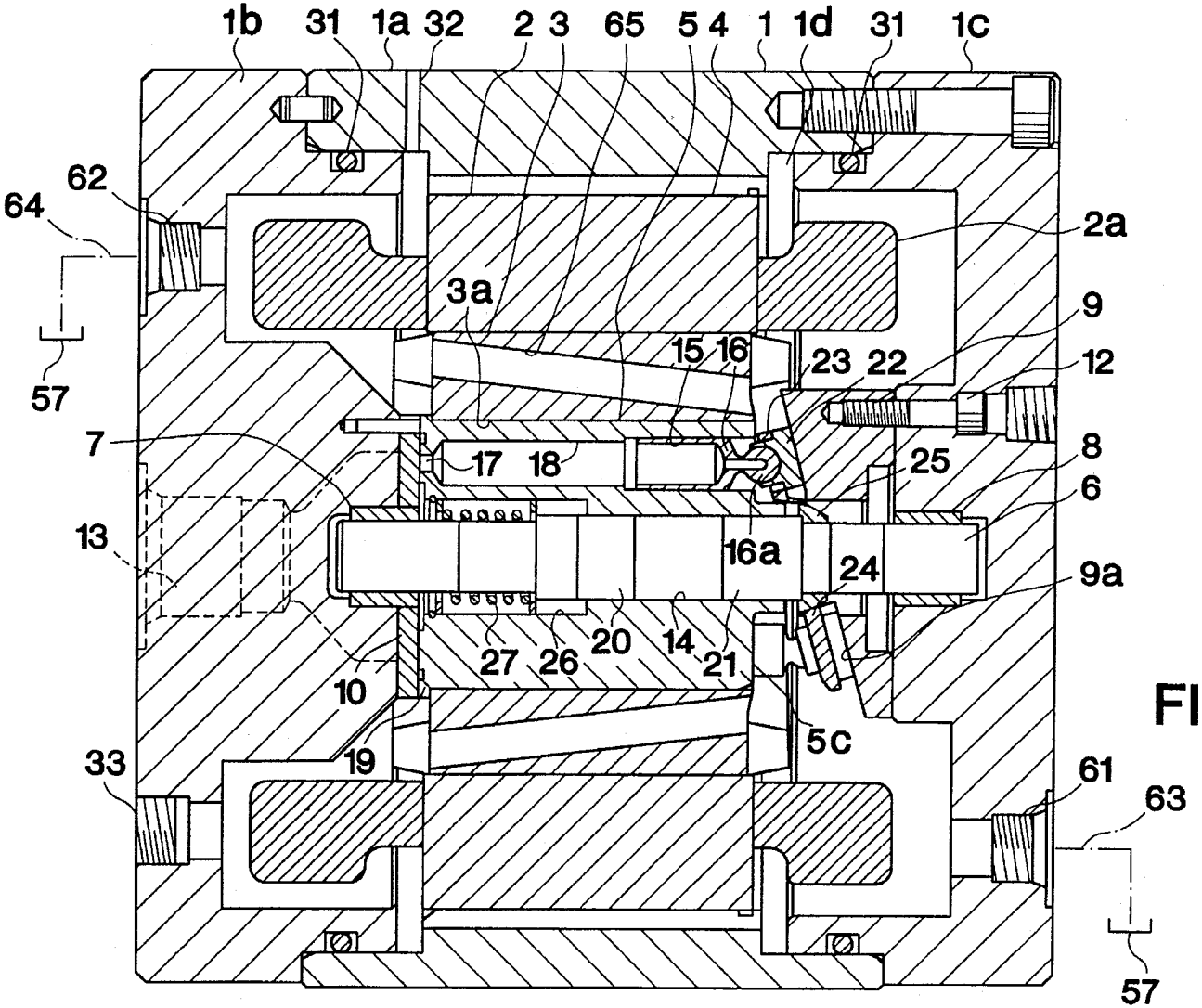
FIG. 11 is a longitudinal sectional view showing an eighth embodiment of the present invention.
Figure 12:
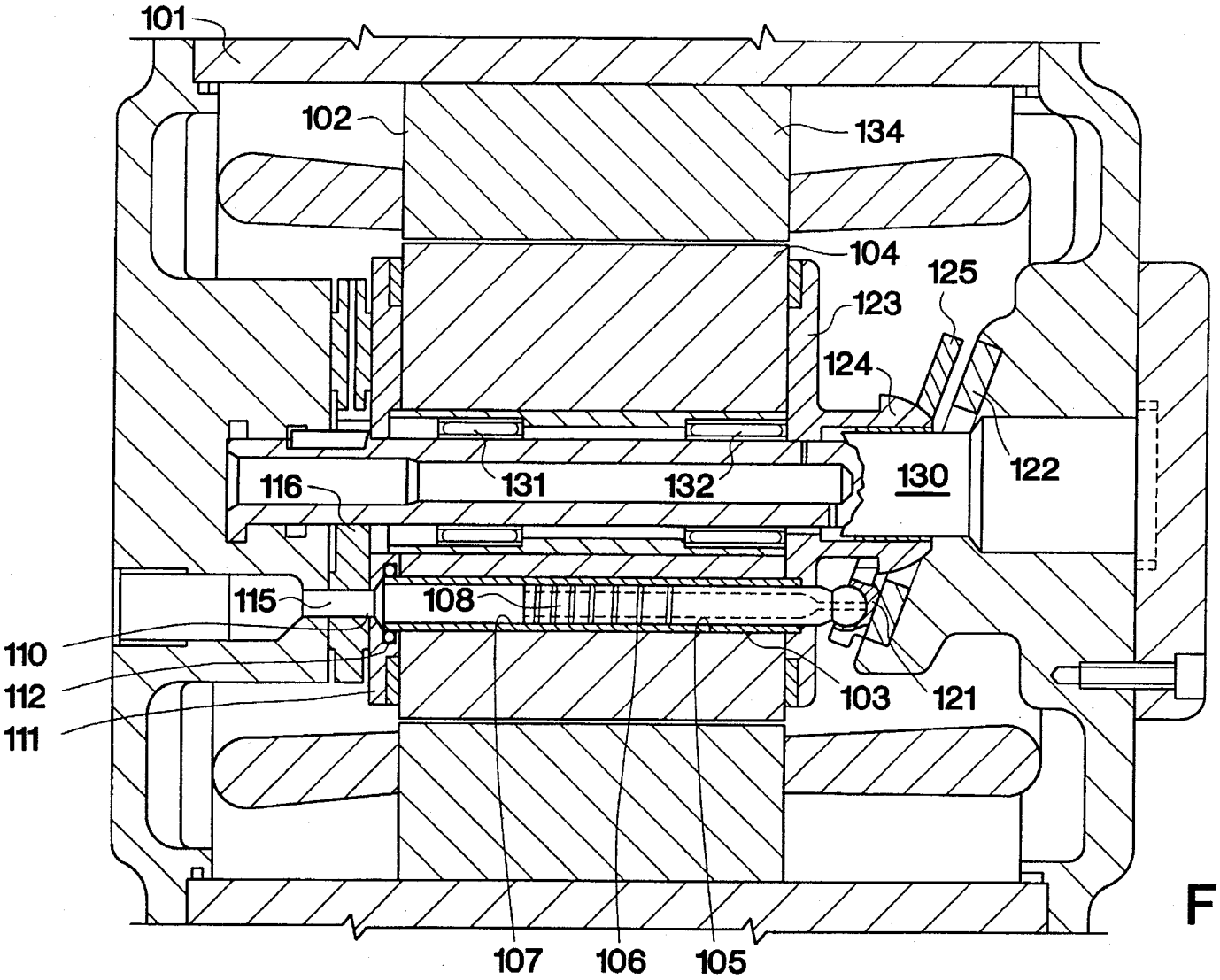
FIG. 12 is a longitudinal sectional view showing a prior-art example.

Further, the eighth embodiment as shown in FIG. 11 is so arranged to implement the motor cooling by fluid, as in the seventh embodiment. However, a difference exists in that separately of the suction and discharge system for sucking and discharging the fluid into and from the cylinders 15, a fluid distribution system is provided exclusively for use of cooling. This eighth embodiment, like the first embodiment shown in FIG. 1, is such that the suction passage 13 and the discharge passage are provided in the cover plate 1*b* so as to communicate with the suction port and the discharge port, respectively, of the valve plate 10 and that a fluid inlet port 61 and a fluid outlet port 62 are provided to the cover plates 1*b*, 1*c* so as to open to the internal space 1*d*. The inlet port 61 and outlet port 62 are made to communicate with the fluid reservoir 57 via a suction tube 63 and a discharge tube 64, respectively. The rotor 3 is provided with an oblique hole 65 for generating fluid flow from the inlet port 61 to the outlet port 62.

When the fluid distribution system exclusively for cooling is provided independently of the suction and discharge system, wear chips, if generated by the drive of the motor 4, would not be mixed into the suction and discharge system. Thus, such a disadvantage can be avoided that wear chips are sucked into the cylinders 15 to adversely affect the sliding movement of the pistons 16. Also, with the inclination angle variable, as shown in FIGS. 2 through 5, the motor cooling can be effected only if the motor is driven, even at the neutral position of the swash plate.

In the above arrangement, the oblique hole 65 is to form the fluid feed means for serving as a pump that feeds fluid from the inlet port 61 side toward the outlet port 62 side by centrifugal force due to rotation of the rotor 3. Thus, the oblique hole 65, which has been provided in the rotor 3 of the above embodiment, may also be provided in the cylinder block 5, or between them.

Embodiments described hereinabove are typical ones and they may be combined with one another. Also, although the bearings 7, 8 of the main shaft 6 in the above embodiments have been provided in the cover plates 1*b*, 1*c* in all cases, they may instead be provided to a member fixed to the cover plates 1*b*, 1*c*, i.e. a stationary member including the casing 1 so as to support the main shaft 6.

In addition, although the fluid in the above description is oil, the invention is also applicable to liquids other than oil.

Industrial Applicability

The fluid pressure generating device of the present invention is used for hydraulic systems such-as of machine tools, vehicles, and construction machines.

We claim:

1. A fluid pressure generating device comprising:

a casing;

a motor positioned in the casing and provided with a rotor having a fitting hole positioned substantially at a center thereof;

a cylinder block having a main shaft at substantially a center thereof and a plurality of cylinders on an outer peripheral portion, wherein pistons are slidably mounted in said cylinders, each piston having a head portion on one side of the cylinders, and the cylinder block further having ports with a sectional area smaller than the sectional area of the cylinders on the other side of the cylinders opposite to the pistons;

a piston actuator arranged opposite to the head portions and having an inclined surface on which the head portions slide; and a valve plate arranged opposite to one end of the cylinder block opposite to the piston side and having a suction port and a discharge port communicating with a suction passage and a discharge passage, respectively;

wherein the cylinder block is fixedly fitted to the fitting hole of the rotor and the main shaft is supported by the casing, so that the rotor is rotatably supported by the casing via the cylinder block and the main shaft.

2. The fluid pressure generating device as claimed in claim 1, wherein the cylinder block and the main shaft are distinct members and coupled with each other so as to be movable relative to each other in the axial direction via sliding bearings and wherein an elastic member for pressing the cylinder block against the valve plate is provided between the cylinder block and the main shaft.

3. The fluid pressure generating device as claimed in claim 1, wherein the cylinder block is provided with a cylindrical portion disposed on the piston actuator side of the cylinder block and protruding toward the piston actuator, the cylindrical portion being supported by the main shaft.

4. The fluid pressure generating device as claimed in claim 1, wherein from the valve plate end face side of the cylinder block extends a stopper portion.

5. The fluid pressure generating device as claimed in claim 1, wherein the cylinder block comprises a piston stroke portion having a plurality of cylinders containing a piston, and an extended portion extended in the axial direction with respect to the piston stroke portion and having a passage communicating with the cylinders, and wherein the cylinder block is fixedly press fitted to the fitting hole of the rotor only at the extended portion.

6. The fluid pressure generating device as claimed in claim 1, wherein the piston actuator comprises a swash plate having a trunnion shaft and inclination angle of an inclined surface of the swash plate is variable by rotation of the trunnion shaft.

7. The fluid pressure generating device as claimed in claim 1, wherein the piston actuator comprises a cradle type swash plate having an arched surface on its rear side and an operating piece and wherein an inclination angle of an inclined surface of the swash plate is variable by swinging along the arched surface of the swash plate.

8. The fluid pressure generating device as claimed in claim 1, wherein the cylinder block and the main shaft are integrally formed, the main shaft is rotatably supported to the casing, and wherein an elastic member for pressing the cylinder block against the valve plate and pressing the head portions of the pistons against the inclined surface of the piston actuator is provided between the cylinder block and the pistons.

9. The fluid pressure generating device as claimed in claim 1, wherein the main shaft and the cylinder block are formed integrally rotatably, the main shaft is rotatably supported to the stationary member and is provided with a protruding shaft protruding outward of the outer surface of the casing on at least one axial end side of the main shaft.

10. The fluid pressure generating device as claimed in claim 9, wherein the protruding shaft is coupled with a cooling fan.

11. The fluid pressure generating device as claimed in claim 1, wherein the casing is of a closed structure, a fluid inlet port that opens to an internal space of the casing is provided on one axial side relative to the motor which is contained in the casing, and a suction passage one end of which opens to the internal space of the casing and the other end of which opens to a suction port of the valve plate is provided on the other axial side relative to the motor.

12. The fluid pressure generating device as claimed in claim 1, wherein the casing is of a closed structure, the casing is provided with a suction passage and a discharge passage communicating with a suction port and a discharge port, respectively, of the valve plate, a fluid inlet port and a fluid outlet port that open to an internal space of the casing and that communicate with a fluid reservoir are provided on one axial and the other axial sides, respectively, relative to the motor which is contained in the casing, and wherein the rotor is provided with fluid feed means for generating fluid flow from the fluid inlet port to the fluit outlet port.

13. The fluid pressure generating device as claimed in claim 1, wherein a magnet is installed within the casing.

14. The fluid pressure generating device as claimed in claim 1, wherein the cylinder block comprises a piston stroke portion having a plurality of cylinders containing a piston, and an extended portion extended in the axial direction with respect to the piston stroke portion and having a passage communicating with the cylinders, and wherein the cylinder block is fixedly press fitted to the fitting hole of the rotor only at the extended portion.

15. The fluid pressure generating device as claimed in claim 1, wherein the casing is of a closed structure, the casing is provided with a suction passage and a discharge passage communicating with a suction port and a discharge port, respectively, of the valve plate, a fluid inlet port and a fluid outlet port that open to an internal space of the casing and that communicate with a fluid reservoir are provided on one axial and the other axial sides, respectively, relative to the motor which is contained in the casing, and wherein the cylinder block is provided with fluid feed means for generating fluid flow from the fluid inlet port to the fluid outlet port.

16. A fluid pressure generating device comprising:

a casing;

a motor positioned in the casing and provided with a rotor having a fitting hole positioned substantially at a center thereof;

a cylinder block having a main shaft substantially at a center thereof and a plurality of cylinders on an outer peripheral portion, wherein pistons are slidably mounted in said cylinders, each piston having a head portion on one side of the cylinders, and the cylinder block further having ports with a sectional area smaller than the sectional area of the cylinders on the other side of the cylinders opposite to the pistons;

a piston actuator arranged opposite to the head portions and having an inclined surface on which a shoe retained by the head portions will slide; and a valve plate arranged opposite to one end of the cylinder block opposite to the piston side and having a suction port and a discharge port communicating with a suction passage and a discharge passage, respectively;

wherein the cylinder block is fixedly fitted to the fitting hole of the rotor and the main shaft is supported by the casing, so that the rotor is rotatably supported by the casing via the cylinder block and the main shaft.

17. The fluid pressure generating device as claimed in claim 16, wherein the cylinder block and the main shaft are fixedly fitted to each other, the main shaft is rotatably supported to a stationary member, the shoes retained by the head portions of the pistons are provided with a retainer, the main shaft is axially movably provided with an engaging portion for relatively rotatable engagement with the retainer, the cylinder block is provided with a plurality of pushing pins extending toward the engaging portion, and wherein an elastic member for pressing the cylinder block against the valve plate and pressing the pushing pins so that the shoes are pressed against the inclined surface of the piston actuator is provided between the cylinder block and the pushing pins.

18. The fluid pressure generating device as claimed in claim 16, wherein the cylinder block and the main shaft are integrally formed, the main shaft is rotatably supported to the stationary member, and wherein an elastic member for pressing the cylinder block against the valve plate and pressing the shoes retained by the head portions against the inclined surface of the piston actuator is provided between the cylinder block and the pistons.

19. The fluid pressure generating device as claimed in claim 16, wherein the cylinder block and the main shaft are distinct members and coupled with each other so as to be movable relative to each other in the axial direction via sliding bearings, the shoes retained by the head portions of the pistons are provided with a retainer, the main shaft is provided with an engaging portion for engagement with the retainer in a relatively rotatable manner, and wherein an elastic member for pressing the cylinder block against the valve plate and pressing the shoes against the inclined surface of the piston actuator via the main shaft and the retainer is provided between the cylinder block and the main shaft.

20. The fluid pressure generating device as claimed in claim 16, wherein the cylinder block is provided with a cylindrical portion disposed on the piston actuator side of the cylinder block and protruding toward the piston actuator, the cylindrical portion being supported by the main shaft.

21. The fluid pressure generating device as claimed in claim 16, wherein from the valve plate end face side of the cylinder block extends a stopper portion.

22. The fluid pressure generating device as claimed in claim 16, wherein the piston actuator comprises a swash plate having a trunnion shaft and inclination angle of an inclined surface of the swash plate is variable by rotation of the trunnion shaft.

23. The fluid pressure generating device as claimed in claim 16, wherein the piston actuator comprises a cradle type swash plate having an arched surface on its rear side and an operating piece and wherein an inclination angle of an inclined surface of the swash plate is variable by swinging along the arched surface of the swash plate.

24. The fluid pressure generating device as claimed in claim 16, wherein the main shaft and the cylinder block are formed integrally rotatably, the main shaft is rotatably supported to the stationary member and is provided with a protruding shaft protruding outward of the outer surface of the casing on at least one axial end side of the main shaft.

25. The fluid pressure generating device as claimed in claim 24, wherein the protruding shaft is coupled with a cooling fan.

26. The fluid pressure generating device as claimed in claim 16, wherein the casing is of a closed structure, a fluid inlet port that opens to an internal space of the casing is provided on one axial side relative to the motor which is contained in the casing, and a suction passage one end of which opens to the internal space of the casing and the other end of which opens to a suction port of the valve plate is provided on the other axial side relative to the motor.

27. The fluid pressure generating device as claimed in claim 16, wherein a magnet is installed within the casing.

* * * * *